US005101798A

United States Patent [19]

Tomsett

[11] Patent Number: 5,101,798

[45] Date of Patent: Apr. 7, 1992

[54] FUEL PUMPING APPARATUS

[75] Inventor: Derek W. Tomsett, East Sussex, England

[73] Assignee: Lucas Industries, Solihull, England

[21] Appl. No.: 731,966

[22] Filed: Jul. 18, 1991

[30] Foreign Application Priority Data

Jul. 28, 1990 [GB] .United Kingdom ..... 9016642

[51] Int. Cl.[5] ..... F02M 41/06

[52] U.S. Cl. ..... 123/506; 123/450; 417/440

[58] Field of Search ..... 123/450, 506, 447, 372, 123/385-387; 417/462, 440, 279

[56] References Cited

U.S. PATENT DOCUMENTS

| | | | |
|---|---|---|---|
| 3,288,124 | 11/1966 | Roosa | 123/385 |
| 4,176,640 | 12/1979 | Skinner | 123/450 |
| 4,446,836 | 5/1984 | Mowbray | 123/450 |
| 4,601,274 | 7/1986 | Seilly | 123/447 |
| 4,920,940 | 5/1990 | Harris | 123/450 |
| 5,035,587 | 7/1991 | Collingborn | 123/506 |
| 5,044,345 | 9/1991 | Collingborn | 123/450 |
| 5,044,893 | 9/1991 | Collingborn | 123/506 |
| 5,044,898 | 9/1991 | Harris | 123/450 |
| 5,044,899 | 9/1991 | Nicol | 123/450 |

FOREIGN PATENT DOCUMENTS

| | | | |
|---|---|---|---|
| 0381343 | 8/1990 | European Pat. Off. | 123/450 |
| 1218215 | 12/1990 | Fed. Rep. of Germany . | |
| 1122886 | 5/1967 | United Kingdom . | |

*Primary Examiner*—Carl Stuart Miller
*Attorney, Agent, or Firm*—Jenner & Block

[57] ABSTRACT

A distributor type fuel pumping apparatus includes pumping plungers and auxiliary plungers both operated by cams as the distributor member is rotated. The pumping plungers are housed in a bore from which fuel is delivered to outlets in turn. In order to control the start and function of fuel delivery a shuttle is movable axially by the fluid delivered by the auxiliary plungers and is angularly adjustable. A sleeve is mounted about the shuttle and is movable axially in response to engine speed. The shuttle and sleeves define a spill path through which fuel can escape from the bore and which is closed after a first predetermined axial movement of the shuttle and they also define a flow path which is opened after a further predetermined axial movement of the shuttle. Fluid flow through the flow path operates a spill valve to allow spillage of fuel from the bore.

8 Claims, 1 Drawing Sheet

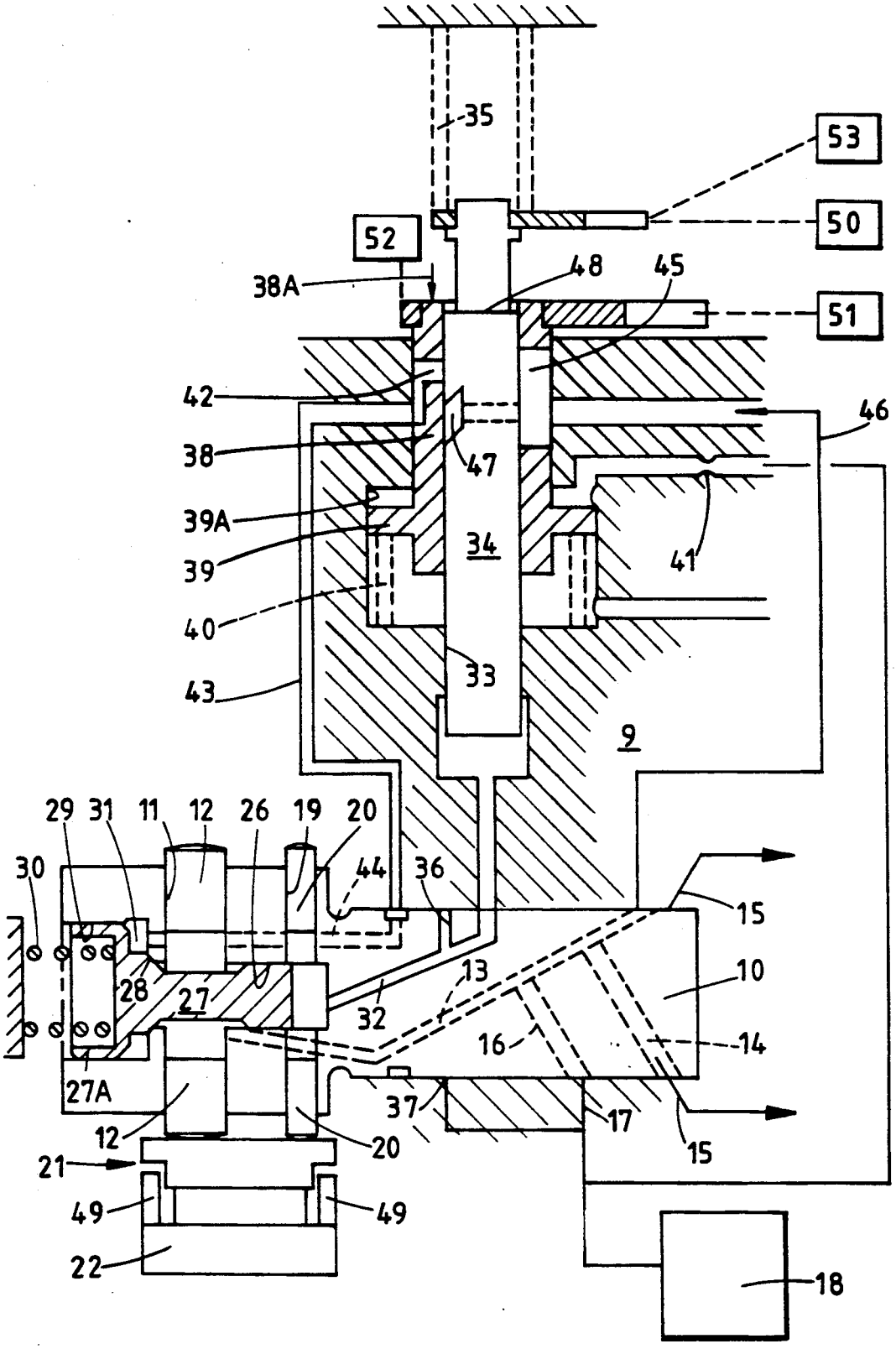
35
53
50
52
38A
48
45
51
42
46
38
47
39A
39
34
41
40
33
43
9
29
31
11
12
26
19
20
30
44
36
15
10
13
28
27
32
16
14
27A
37
17
12
20
15
21
49
49
22
18

FUEL PUMPING APPARATUS

This invention relates to fuel pumping apparatus for supplying fuel to an internal combustion engine and of the kind comprising a rotary distributor member mounted in a body, a transverse bore in the distributor member and a pair of pumping plungers located in the bore, means for feeding fuel to the bore to effect outward movement of the plungers, cam means for imparting inward movement to the plungers as the distributor member rotates, passage means connecting the bore to a plurality of outlet ports in turn during successive inward movements of the pumping plungers, a spill valve operable to spill fuel from the bore during the inward movement of the pumping plungers, a fluid pressure operable actuator for controlling the opening of said spill valve, a pair of auxiliary plungers located in the distributor member and operable by said cam means, a valve operable by the fluid displaced by the auxiliary plungers to control the application of fluid under pressure to said actuator.

It is known in the art of fuel pumping apparatus incorporating rotary distributor members, to vary the timing of delivery of fuel by moving the cam means about the axis of rotation of the distributor member using a fluid pressure operable piston. The piston has to absorb the reaction on the cam means and as the pressure at which fuel is supplied by the apparatus is increased in an attempt to meet emission requirements, there is an increased tendency for some movement of the piston to take place whilst the plungers are being moved inwardly by the cam means. If movement of the piston does take place the commencement of fuel delivery will be retarded and furthermore, the rate of delivery of fuel will be reduced. Various proposals have been made to try to minimise or prevent movement of the piston but with varying degrees of success. Moreover, the known methods employing servo valves for example to control flow of liquid into the cylinder containing the piston add considerably to the cost of manufacturing the apparatus.

The object of the present invention is to provide an apparatus of the kind set forth in a simple and convenient form.

According to the invention in an apparatus of the kind specified said valve means comprises an angularly and axially movable shuttle mounted in a cylinder in the body, means biasing the shuttle to one end of said bore, the auxiliary plungers displacing liquid to said one end of the cylinder thereby causing axial movement of the shuttle, a sleeve surrounding a portion of the shuttle, the shuttle and the sleeve defining a spill path from said bore, means for moving the sleeve axially in the body, said spill path being closed after a predetermined movement of the shuttle relative to the sleeve in the direction way from said one end of the cylinder thereby to allow delivery of fuel through an outlet, and said shuttle and said sleeve defining a flow path which is opened after a further predetermined movement of the shuttle relative to the sleeve in the direction away from said one end of the cylinder and depending upon the angular setting of the shuttle, thereby to apply fluid under pressure to said actuator to terminate the delivery of fuel through the outlet.

An example of a pumping apparatus in accordance with the invention will now be described with reference to the accompanying diagrammatic drawing.

Referring to the drawing the apparatus comprises a rotary cylindrical distributor member 10 which is mounted within a body 9 and which is driven in timed relationship with the associated engine. The distributor member is provided with a transverse bore 11 in which is mounted a pair of pumping plungers 12. The pumping chamber defined intermediate the plungers is connected to a passage 13 formed in the distributor member and from which extends a delivery passage 14 positioned to register in turn with a plurality of outlet ports 15 formed in the body and connected in use to the injection nozzles of the associated engine respectively. Also extending from the passage 13 is an inlet passage 16 which is positioned to register in turn with a plurality of inlet ports 17 only one of which is shown, formed in the body and connected to the outlet of a low pressure fuel pump 18. Also formed in the distributor member is a further transverse bore 19 in which is located a pair of auxiliary plungers 20. These plungers are of smaller diameter than the plungers 12 and the two sets of plungers are mounted in side by side relationship. The plungers 12 and 20 are actuated by cam followers 21 only one of which is shown, each cam follower comprising a shoe which is in engagement with the outer ends of the plungers, and a roller which is carried by the shoe and which engages with the internal peripheral surface of an annular cam ring part of which is seen as 22. The cam ring in known manner, is provided with pairs of inwardly directed cam lobes. In conventional pumps of this type the cam ring is angularly movable about the axis of rotation of the distributor member to enable the timing of fuel delivery to be varied but in this case, the cam ring 22 is fixed within the body.

Traversing the bores 11 and 19 is an axial drilling 26 in which is mounted a spill valve member 27 shaped to cooperate with a seating 28 formed at the junction of the drilling 26 and the wall of a chamber 29. The valve member is coupled to an actuator which is in the form of a cup shaped piston member 27A slidable in the chamber 29 and which is biased by a spring 30 so that the valve member is urged into engagement with the seating 28. Between the base wall of the chamber 29 and the cup shaped piston member 27A there is formed a spill chamber 31. The inner end of the drilling 26 is connected by means of a passage 32 in the distributor member with the inner end of a shuttle cylinder 33 which is formed in the body surrounding the distributor member. Slidable in the shuttle cylinder is a shuttle 34 which is spring biased towards the one end of the cylinder by a light spring 35.

The passage 32 is provided with a branch passage 36 which opens onto the periphery of the distributor member and which is positioned to register in turn with a plurality of ports 37 only one of which is shown which are connected to the outlet of the low pressure pump 18.

Slidable about the shuttle is a sleeve 38 which itself is slidably mounted in the body. The sleeve is formed with a piston 39 which is slidable in an enlarged portion 39A of the cylinder. The sleeve is biased by means of a coiled compression spring 40 away from said one end of the cylinder 33 and the portion of the cylinder 39A which contains the spring, is connected to a drain. A stop 38A is provided to limit the movement of the sleeve by the spring. The portion of the cylinder 39A which lies on the opposite side of the piston 39 is connected to the outlet of the low pressure pump 18, the connection including a restrictor 41.

Formed in the wall of the sleeve is a port 42 which is connected by means of a passage 43 in the body and a passage 44 in the distributor member, with the spill chamber 31. Moreover, also formed in the sleeve is an elongated slot 45 which through a passage 46 in the body and which opens onto the periphery of the distributor member, is in constant communication with the passage 13 although if desired and as shown, this communication can be ported so that the communication is only established during inward movement of the pumping plungers 12.

Formed on the periphery of the shuttle 34 is a helical groove 47 which by way of an internal passage in the shuttle, is in constant communication with the slot 45. The groove 47 and the port 42 define a flow path through which fuel under pressure can flow to act upon the piston 27A.

Defined on the shuttle is a step 48 and this step when the shuttle is at said one end of the cylinder, uncovers the slot 45 forming a spill path through which fuel can escape into a chamber not shown, defined in the body.

The operation of the apparatus will now be described ignoring for the moment, the plungers 20 and the shuttle and sleeve. During inward movement of the plungers 12 by the cam lobes, fuel is delivered from the pumping chamber and flows along the passage 13 to the delivery passage 14 and to an outlet 15. The communication of the inlet passage 16 with an inlet port 17 is at this time broken and fuel is supplied to the associated engine. As the distributor member continues to rotate the delivery passage 14 moves out of register with an outlet port 15 and the inlet passage 16 moves into register with an inlet port 17 and fuel is supplied to the pumping chamber to cause outward movement of the plungers 12 by an amount determined by in the particular example, abutment of the shoes of the cam followers with stop rings 49. The cycle is repeated as the distributor member rotates and fuel is supplied to the outlets 15 in turn.

Considering now the operation of the auxiliary plungers. As the plungers 12 move inwardly so also will the auxiliary plungers 20 and fuel will be displaced along the passage 32 into the one end of the shuttle cylinder 33 so that movement of the shuttle against the action of its spring will take place. However, the passage 13 is also in communication with the passage 46 at this time and fuel from the pumping chamber will flow through this passage into the elongated slot 45 and into the aforesaid chamber in the body. As the plungers move inwardly a position will be reached at which the step 48 obturates the slot 45 and when this occurs the spill path formed by the step and the slot is closed and fuel can no longer escape and is therefore supplied to the associated engine. Both sets of plungers continue to move inwardly and the shuttle continues to move away from the one end of the cylinder against the action of the spring. A point will be reached however at which the groove 47 is brought into register with the port 42 thereby opening the flow path defined by the groove and the port and when this occurs fuel at the high pressure which is generated by the plungers 12 will be supplied to the chamber 31 and will effect movement of the piston member 27A and in particular will lift the valve member 27 from the seating 28 thereby to allow the remaining quantity of fuel delivered by the plungers 12 to flow into the spill chamber 31. There will therefore be a rapid reduction in the pressure of fuel which is supplied through the outlet 15 and a consequent rapid closure of the valve member in the respective fuel injection nozzle.

As the distributor member continues to rotate and the plungers are allowed to move outwardly, the shuttle 34 will return to the one end of the cylinder and the fuel contained in the spill chamber 31 will be returned to the bore 11. The fuel which has been displaced to the associated engine or has been lost through spillage and leakage is made up by flow of fresh fuel from the low pressure pump 18 as described.

The shuttle 34 is angularly adjustable to determine the amount of fuel which is supplied to the associated engine.

The position of the sleeve 38 is dependent upon the output pressure of the low pressure pump 18 and this by use of a pressure control valve, varies in accordance with the speed at which the distributor member rotates. The axial position of the sleeve 38 therefore is dependent upon the speed of the associated engine and as the sleeve is moved against the action of the spring 40, the instant at which the step 48 obturates the slot 45 will occur earlier in the inward movement of the plungers. The timing of delivery of fuel to the associated engine will therefore be advanced. As the speed of the associated engine falls the timing of delivery of fuel will be retarded.

The angular setting of the shuttle 34 can be determined by a governor mechanism 50 which includes an operator adjustable member which enables the operator to control the amount of fuel supplied to the engine within limits determined by the governor. Moreover, the sleeve 38 can also be moved angularly by a mechanism 51 responsive to an engine operating parameter for example, the pressure of air within the inlet manifold of the engine. As the air pressure increases for example if a turbo super charger is used, the sleeve can be moved angularly to increase the amount of fuel supplied to the engine for a given angular setting of the shuttle 34.

The apparatus as described can be controlled by an electronic control system. In this case the shuttle 34 would be moved angularly by an electro-magnetic actuator 53 and the axial position of the sleeve 38 controlled by a further actuator 52. In this case angular movement of the sleeve is not necessary because the control system can control the angular position of the shuttle 34 to provide the required fuel control when for example the engine is provided with a turbo super charger.

Whilst as described it is possible to use an actuator to set the axial position of the sleeve, the form of control illustrated in the drawing can be utilised with an electrically operated control valve to control the application of fuel under pressure to the piston 39.

In a conventional distributor type of pumping apparatus where the quantity of fuel is controlled by spilling fuel from the pumping chamber towards the end of the pumping stroke of the plungers, it is not possible to vary the rate at which fuel is delivered to the associated engine since the plungers are always moved inwardly by the same portion of the leading flanks of the cam lobes. With the arrangement as described however the leading flanks of the cam lobes can be profiled so that the initial rate of fuel delivery can be varied depending upon the timing of fuel delivery to the engine.

In a practical version of the apparatus as described four pumping plungers 12 and four auxiliary plungers 20 will be provided, the additional pairs of plungers being located in further transverse bores 11, 19 located at right angles in the case of an apparatus for supplying fuel to a four cylinder engine, to the existing bores.

I claim:

1. A fuel pumping apparatus for supplying fuel to an internal combustion engine comprising a rotary distributor member mounted in a body, a transverse bore in the distributor member and a pair of pumping plungers located in the bore, means for feeding fuel to the bore to effect outward movement of the plungers, cam means for imparting inward movement to the plungers as the distributor member rotates, passage means connecting the bore to a plurality of outlet ports in turn during successive inward movement of the pumping plungers, a spill valve operable to spill fuel from the bore during the inward movement of the pumping plungers, a fluid pressure operable actuator for controlling the opening of the spill valve, a pair of auxiliary plungers located in the distributor member and operable by said cam means and valve means operable by the fluid displaced by the auxiliary plungers to control the application of fluid under pressure to said actuator thereby to open said spill valve to terminate delivery of fuel through an outlet port, said valve means comprising an angularly and axially movable shuttle mounted in a cylinder, in the body, means biasing the shuttle to one end of said bore, the auxiliary plungers displacing liquid to said one end of the cylinder thereby causing axial movement of the shuttle, a sleeve surrounding a portion of the shuttle the shuttle and the sleeve defining a spill path from said bore, means for moving the sleeve axially in the body, said spill path being closed after a predetermined movement of the shuttle relative to the sleeve in the direction away from said one end of the cylinder thereby to allow delivery of fuel through an outlet, and said shuttle and said sleeve defining a flow path which is opened after a further predetermined movement of the shuttle relative to the sleeve in the direction away from said one end of the cylinder and depending upon the angular setting of the shuttle, thereby to apply fluid under pressure to said actuator to terminate the delivery of fuel through the outlet.

2. An apparatus according to claim 1 in which said spill path is defined by a slot in the wall of said sleeve and a step formed on said shuttle, said slot during inward movement of the pumping plungers being in communication with said bore.

3. An apparatus according to claim 2, in which said flow path is defined by a port in the wall of said sleeve and a helical groove formed on the periphery of the shuttle.

4. An apparatus according to claim 3, in which said helical groove is in constant communication with said slot.

5. An apparatus according to claim 3, in which the means for moving the sleeve axially comprises a piston on the sleeve which is slidable within a further cylinder, a spring biasing the piston in the direction away from said one end of the first cylinder and a passage through which fuel under pressure can be admitted to the further cylinder to move the piston against the action of the spring, said passage being connected to a source of fuel the pressure of which varies in accordance with the speed of the associated engine.

6. An apparatus according to claim 5, including a mechanism responsive to an engine operating parameter other than speed for moving the sleeve angularly.

7. An apparatus according to claim 5, including a governor mechanism for varying the angular setting of the shuttle.

8. An apparatus according to claim 3, including a first actuator for moving the shuttle angularly and a second actuator for moving the sleeve axially.

* * * * *